US006547932B1

(12) United States Patent
Leinonen et al.

(10) Patent No.: US 6,547,932 B1
(45) Date of Patent: Apr. 15, 2003

(54) DOCTOR EQUIPMENT IN CONNECTION WITH A ROLL/CYLINDER IN A PAPER/BOARD MACHINE

(75) Inventors: Antti Leinonen, Laukaa (FI); Jouni Heiskanen, Jyväskylä (FI); Kari Paloniemi, Jyväskylä (FI); Kari Lamminmäki, Jyväskylä (FI); Ilkka Rata, Jyväskylä (FI); Ilkka Eskelinen, Varkaus (FI); Samppa J. Salminen, Jyväskylä (FI); Aimo Närväinen, Palokka (FI); Pentti Luoma, Jyskä (FI); Jukka Samppala, Jyväskylä (FI); Mika Saari, Jyväskylä (FI); Reijo Hassinen, Leppävesi (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/890,697

(22) PCT Filed: Feb. 2, 2000

(86) PCT No.: PCT/FI00/00071

§ 371 (c)(1),
(2), (4) Date: Jan. 16, 2002

(87) PCT Pub. No.: WO00/46446

PCT Pub. Date: Aug. 10, 2000

(30) Foreign Application Priority Data

Feb. 3, 1999 (FI) ..... 990201

(51) Int. Cl.[7] ..... D21G 3/00

(52) U.S. Cl. ..... 162/281; 162/198; 162/199; 162/272; 162/276; 34/85; 34/110

(58) Field of Search ..... 162/272, 276, 162/198, 199, 281; 34/85, 110; 118/110; 15/256.51, 256.53; 101/157

(56) References Cited

U.S. PATENT DOCUMENTS

| | | | | |
|---|---|---|---|---|
| 3,748,686 | A | 7/1973 | Winterburn et al. | 15/256.51 |
| 3,750,228 | A | 8/1973 | Wake | 15/256.53 |
| 5,597,449 | A | 1/1997 | Vestola et al. | 162/199 |

FOREIGN PATENT DOCUMENTS

| | | |
|---|---|---|
| EP | 0485597 | 5/1992 |
| SE | 7107361-3 | 6/1970 |
| WO | 9404348 | 3/1994 |

*Primary Examiner*—Steven P. Griffin
*Assistant Examiner*—Mark Halpern
(74) *Attorney, Agent, or Firm*—Steinberg & Raskin, P.C.

(57) ABSTRACT

The invention relates to a doctor apparatus (10) in connection with a roll (T) in a paper or board machine. The doctor apparatus (10) comprises a doctor beam (12) of lightweight construction and that the doctor beam (12) is arranged to pivot on bearing means (13$a_1$, 13$a_2$ . . . ) (pivot movement arrow $L_1$). In connection with the doctor beam there are loading members (14$a_1$, 14$a_2$), a relative linear movement taking place between the loading members (14$a_1$, 14$a_2$) and backup surfaces (12', 15$a$') when the doctor beam (12) is being oscillated.

17 Claims, 4 Drawing Sheets

DOCTOR EQUIPMENT IN CONNECTION WITH A ROLL/CYLINDER IN A PAPER/BOARD MACHINE

FIELD OF THE INVENTION

The invention relates to a doctor apparatus in connection with a roll or a cylinder in a paper or board machine.

The invention relates to a doctor apparatus in connection with a roll or a cylinder in a paper or board machine.

BACKGROUND OF THE INVENTION

The large structural dimensions of doctor beams and the fact that doctor beams become heavy pose a problem in the arrangements of prior art. This means, for instance, that it is almost impossible to produce an oscillation movement for a doctor beam. Large dimensions and heavy beams have led to the fact that construction of doctor beams has thus become a costly working step. The cost of material alone has been high. In this application, attempts have been made to form a totally novel type of doctor beam by means of which the big problems arising from heavy doctor beams in the prior art structures are avoided. In the invention, a doctor beam structure has been formed in which it has been possible to form the doctor beam, being advantageously made of a composite material, into a lightweight rib-like part, and into which doctor beam it has already in itself been possible to form blade holder structures, i.e. the doctor beam itself constitutes a blade holder. In accordance with the invention, the bearing arrangement of the doctor beam is accomplished such that the doctor beam can be both oscillated and pivoted by means of loading hoses. A pneumatic cylinder is advantageously used as an oscillation actuator, in which connection counterforce and counter-motion are produced by means of a spring fixed between the doctor beam and a frame.

BRIEF DESCRIPTION OF THE DRAWINGS

The invention will be described below with reference to some advantageous embodiments of the invention shown in the figures of the accompanying drawings, to which embodiments the invention is, however, not intended to be exclusively confined.

DETAILED DESCRIPTION OF THE INVENTION

Figure 1A:
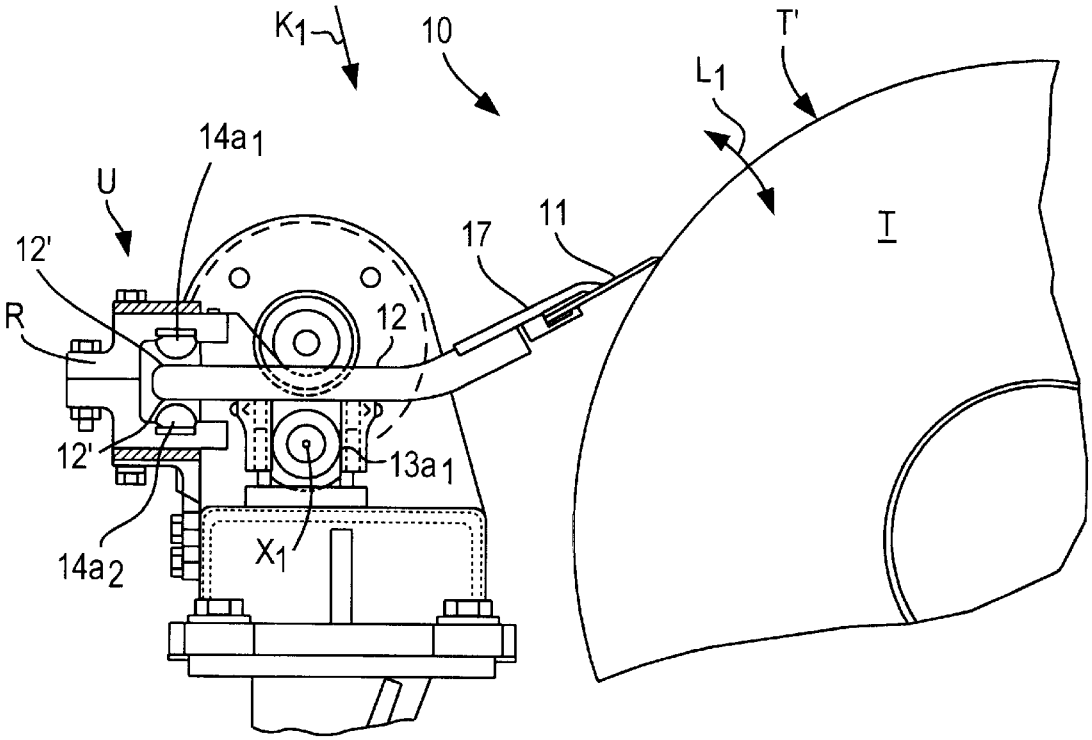
FIG. 1A shows a first advantageous embodiment of the invention in which a doctor apparatus is in connection with a roll T.
Figure 1B:
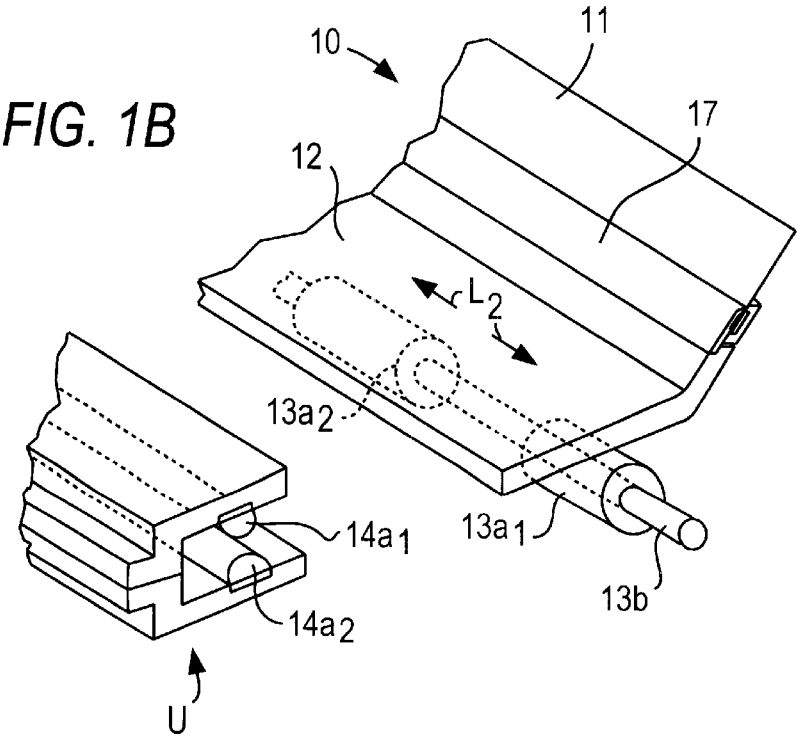
FIG. 1B shows the apparatus seen in the direction of an arrow $k_1$ in FIG. 1 and the main parts of the structure as separated from each other to show the parts.

FIG. 1A shows a first advantageous embodiment of a doctor apparatus 10 of the invention. FIG. 1B shows the apparatus of FIG. 1A as an axonometric partial illustration mainly in the direction of an arrow $k_1$ shown in FIG. 1A and with parts U and 12 placed apart from each other. In order to illustrate the parts, loading hoses 14$a_1$, 14$a_2$ and the frame part U associated with them are depicted as separated from the doctor beam 12. The doctor apparatus 10 comprises a doctor blade 11 which is to be pressed against the surface of a roll T and which is connected through a blade holder 17 to the doctor beam 12, which is a flat part of lightweight construction, preferably of a composite material, most preferably of carbon fibre. The weight of said doctor beam 12 made of a composite is only a fraction of the weights of conventional doctor beam structures in accordance with the state of the art. In accordance with the invention, the doctor beam is mounted by bearing means 13$a_1$, 13$a_2$ . . . onto a frame R over the length of the doctor beam 12. The doctor beam 12 is mounted by means of bearings and linked pivotally specifically such that the beam is allowed a pivot movement (arrow $L_1$) as well as an oscillation movement (arrow $L_2$). There are a number of bearings 13$a_1$, 13$a_2$ over the length of the doctor beam 11. The apparatus in accordance with the invention comprises loading members 14$a_1$, 14$a_2$ . . . by means of which the doctor beam 12 is being oscillated. Advantageously, the loading members 14$a_1$, 14$a_2$ . . . are loading hoses. In accordance with the invention, the doctor beam 12 is pivoted by means of the loading hose structure 14$a_1$, 14$a_2$, which loading hose structure is fixed further to the frame R by means of a U-shaped piece U. By alternately affecting the loading hoses 14$a_1$, 14$a_2$, the doctor beam 12 is pivoted on the bearing means 13$a_1$, 13$a_2$ . . . as illustrated with the arrow $L_1$ in FIG. 1A. Thus, the loading positioning and the loading of the doctor blade 11 take place by pivoting the doctor beam 12, and in the blade holder 17 itself there are no separate positioning means. Linear oscillation of the doctor beam 12 (arrow $L_2$) is possible because the weight of the doctor beam 12 is low and it is mounted by the bearing means 13$a_1$, 13$a_2$ so as to be linearly well movable in the longitudinal direction of the blade 11. Consequently, in accordance with the invention, the bearings 13$a_1$, 13$a_2$ . . . allow the doctor beam 12 and thus the doctor beam 12, as shown with the arrow $L_1$, to be pivoted about a geometric axis $X_1$ and, similarly, the very same bearings 13$a_1$, 13$a_2$ . . . allow the doctor beam 12 and thus the doctor blade 11 to be oscillated in the direction of the axis $X_1$. Thus, the same bearing means 13$a_1$, 13$a_2$ enable the doctor beam 12 to have two movements: the pivot movement $L_1$ and the linear oscillation movement $L_2$. The bearings 13$a_1$, 13$a_2$ are preferably roller or sliding bearings or ball bearings. In the embodiment of FIGS. 1A and 1B, a shaft 13$b$ is coupled to the frame R and passed through the bearings 13$a_1$, 13$a_2$.

Figure 2:
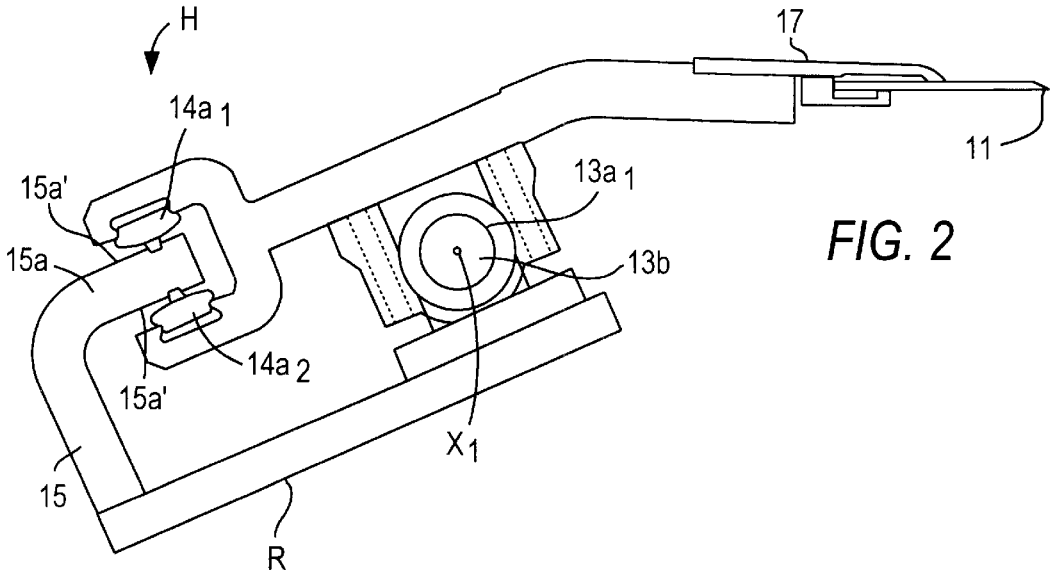
FIG. 2 shows a second embodiment of the invention in which the location of loading hoses differs from that of the embodiment shown in FIGS. 1A and 1B.

FIG. 2 shows an embodiment which differs from the embodiment of FIGS. 1A and 1B in that the doctor beam 12 comprises at its end a U-shaped fork H, to which the loading members 14$a_1$, 14$a_2$, are fixed. The loading members 14$a_1$, 14$a_2$ are preferably loading hoses. Thus, the loading hoses 14$a_1$, 14$a_2$ affect a rib-like end part 15$a$ of a frame part 15 bent into an L shape and fixed to the frame R and glide in oscillation motion along the surface of the rib-like end part 15$a$. Otherwise the embodiment of FIG. 2 corresponds to the embodiment of FIGS. 1A and 1B. Thus, the loading members 14$a_1$, 14$a_2$, preferably loading hoses, can be situated on the frame R outside the doctor beam 12 in accordance with the embodiment of FIGS. 1A and 1B or said loading members 14$a_1$, 14$a_2$, advantageously loading hoses, can be situated on the doctor beam 12 as shown in the embodiment of FIG. 2, in which connection they are arranged to affect the L-shaped frame backup part 15 attached to the frame R. In both embodiments, in the embodiments of both FIGS. 1A, 1B and FIG. 2, by means of the loading hoses 14$a_1$, 14$a_2$ by alternately loading the loading hoses 14$a_1$, 14$a_2$, the doctor beam 12 and the doctor blade 11 attached to it are pivoted and the loading of the blade 11 is accomplished against its backup surface, i.e. a roll surface T' in order to service/condition it (arrow $L_1$). In the embodiment of FIGS. 1A, 1B, in the oscillation movement $L_2$, $L_{2+}$, $L_{2-}$ there is a relative movement between the loading members 14$a_1$, 14$a_2$, preferably loading hoses, and the doctor beam 12, and only the doctor beam 12 moves in the oscillation movement along the loading hoses 14$a_1$, 14$a_2$. In the embodiment of FIGS. 1A, 1B, the loading members 14$a_1$, 14$a_2$ are thus stationary and only the doctor beam 12 moves in the oscillation movement along them. In the embodiment of FIG. 2, the loading hoses 14$a_1$, 14$a_2$ move in the oscillation movement with the beam 12 along a surface 15$a$' of the portion 15$a$ in the L-part 15 attached to the frame R. Thus, there is a relative linear movement between the loading hoses 14$a_1$, 14$a_2$ and their backup surface when the doctor beam 12 is being oscillated. In the embodiment of FIGS. 1A, 1B, the backup or abutment surface is constituted by edge surfaces 12' of the doctor beam 12 and, in the case of the embodiment of FIG. 2, the backup or abutment surface is constituted by the upper and lower surfaces 15$a$' of the end portion 15$a$ in the part 15 attached to the frame R. It is clear that intermediate parts, such as, wearing pieces or bearing pieces, etc. can be used on the loading hoses 14$a_1$, 14$a_2$ and/or on their backup surfaces 12', 15$a'$.

Figure 3A:
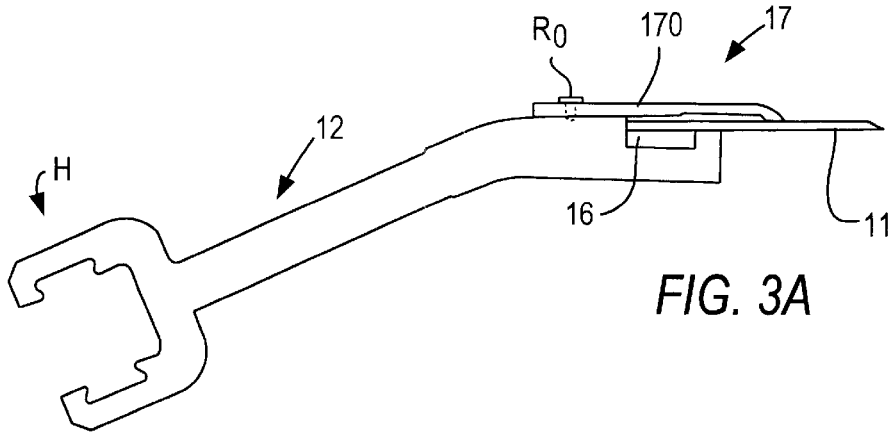
FIG. 3A shows an embodiment of the invention in which there is no separate blade holder.
Figure 3B:
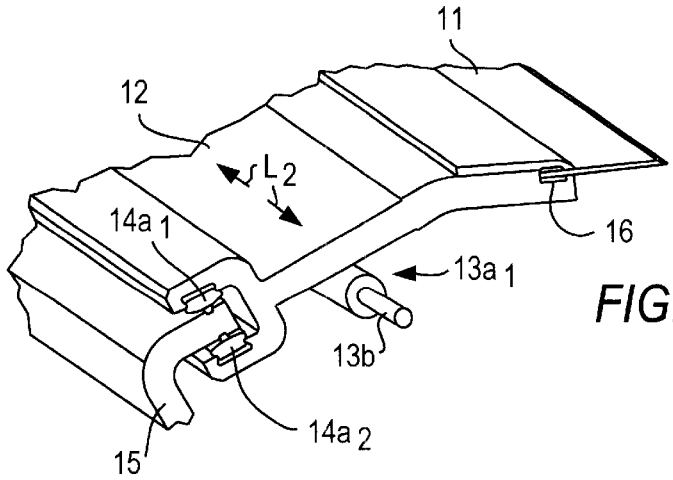
FIG. 3B is an axonometric view of the structure of FIG. 3A.

FIG. 3A is a sectional view of a doctor beam and depicts an embodiment in which there is no separate external blade holder on the doctor beam, and FIG. 3B is an axonometric view of the structural design of FIG. 3A from the end of the doctor beam 12. The doctor beam of FIGS. 3A and 3B is also made of a composite material, for example, of carbon fibre and comprises in its connection a backup recess 16 which is formed at the end of the doctor beam 12 and into which a doctor blade 11 can be placed, in which connection the doctor blade 11 is held secured to the doctor beam 12 by means of a plate 170. The plate 170 is fixed to the doctor beam 12 by means of a screw Ro. A separate lower part of the blade holder is not needed in the embodiment of the figure. Thus, the blade holder 17 is formed so as to constitute a part of the doctor beam 12. It is thus of the same unified structure with the doctor beam 12. The beam embodiment 12 of FIG. 3A can, of course, be used in an arrangement operating in accordance with the embodiment of FIG. 2.

Figure 4A:
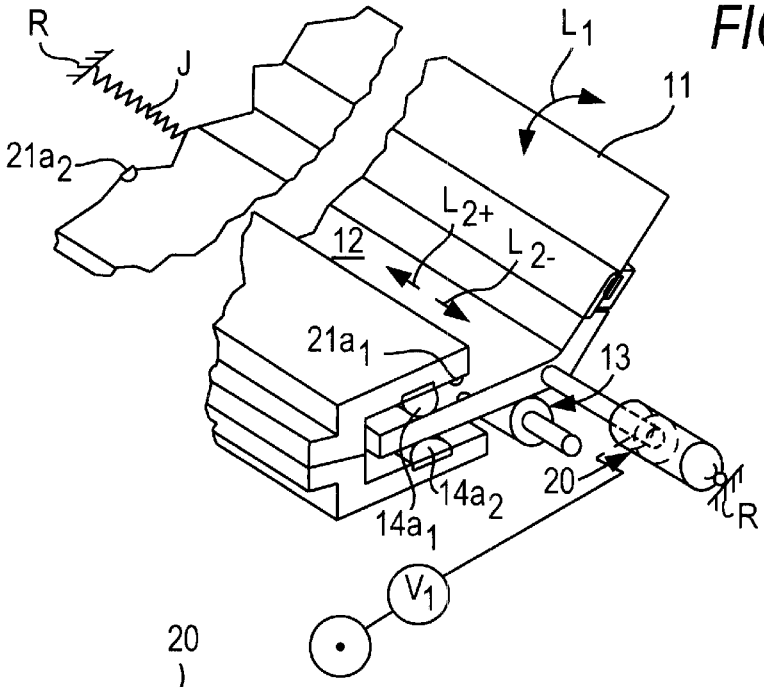
FIG. 4A shows an embodiment of the invention in which the oscillation movement of the doctor beam is produced by means of a pneumatic cylinder.

FIG. 4A shows an embodiment of the invention in which the oscillation movement $L_{2+}$, $L_{2-}$ is produced by means of an oscillation actuator 20, preferably a cylinder. As shown in the figure, the end of the doctor beam 12 is acted upon by means of said cylinder 20. In the embodiment of the figure there is a spring J which provides a counterforce and which is placed between the frame R and the doctor beam 12 at the opposite end of the doctor beam 12 with respect to the cylinder 20. The cylinder 20 is advantageously a pneumatic cylinder. By means of it, the doctor beam is moved during oscillation in the direction $L_{2+}$, as shown in the figure. A valve $V_1$ of the single-action pneumatic cylinder 20 is opened and closed by means of a limit switch 21$a_1$, 21$a_2$ and the doctor beam 12 is moved by means of the spring force of the spring J in the direction $L_{2-}$. The opening and closing of the valve $V_1$ is controlled by means of the limit switches 21$a_1$ and 21$a_2$ at both ends of the doctor beam 12, i.e. the stage at which air under pressure is passed from the valve $V_1$ to the cylinder 20 and the stage at which the pressurized space of the cylinder is opened through the valve $V_1$ into the open air in order to change the direction of the oscillation movement. Within the scope of the invention, it is also possible to provide an oscillation valve arrangement in which a medium under pressure is passed through the valve alternately to different sides of the cylinder, in which connection a spring is not needed. In FIG. 20, the actuator is a cylinder actuator, which may be a pneumatic cylinder or a hydraulic cylinder.

Figure 4B:
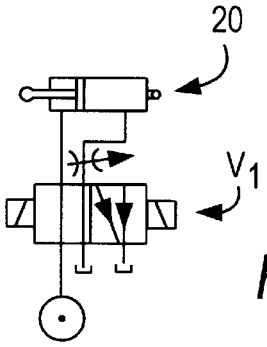
FIG. 4B shows a pneumatics diagram associated with the embodiment of FIG. 4A.

FIG. 4B shows a pneumatics diagram associated with the structure of FIG. 4A.

Figure 4C:
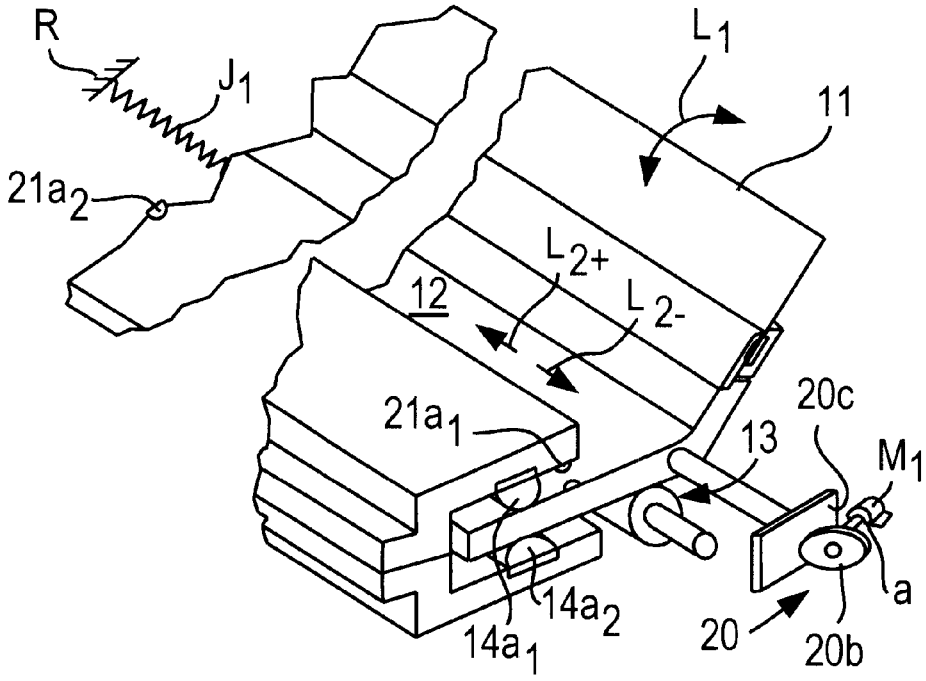
FIG. 4C shows an eccentric actuator as an oscillation actuator.

FIG. 4C shows an embodiment of the invention in which the actuator is an eccentric actuator. The eccentric actuator 20 comprises a motor $M_1$ to the output shaft a of which an eccentric plate or an eccentric disc 20$b$ is connected. The eccentric plate is arranged to affect a backup surface 20$c$, which is connected to the doctor beam 12. The spring $J_1$ in the embodiment of FIG. 4C is a pressure spring. By operating the motor $M_1$, the beam 12 is caused to move in the lateral direction at a given frequency determined by the motor $M_1$.

In accordance with the invention, the actuator 20 may be a magnetic actuator, for example, a magnetostrictive actuator, in which a magnetostrictive material is brought to a magnetic field and set into a deflection movement at a desired adjustable frequency.

Figure 5:
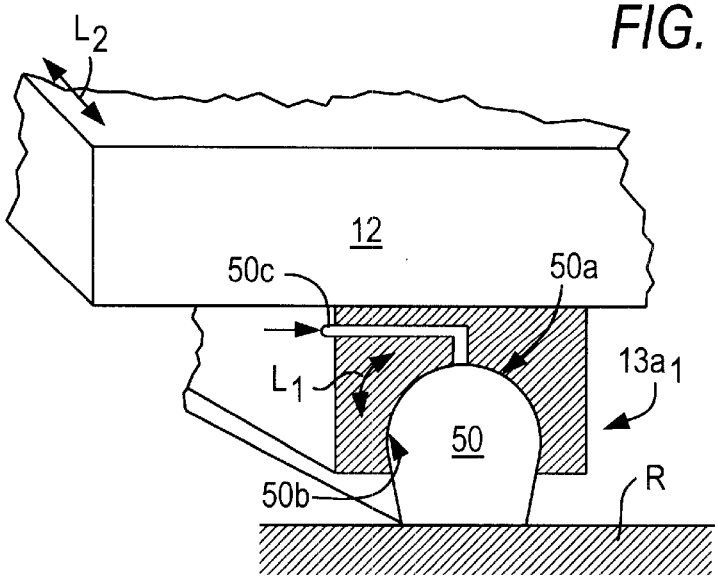
FIG. 5 shows an embodiment of the invention in which the bearing arrangement of the doctor beam is accomplished by means of a hydrodynamic bearing.

FIG. 5 shows an embodiment of the invention in which the bearing arrangement between the doctor beam and the frame R is accomplished by means of a hydrodynamic bearing/bearings 13$a_1$, 13$a_2$, which are formed of an elongated guide 50 extending in the longitudinal direction of the doctor beam and of an abutment piece associated with the doctor beam 12 allowing the linear movement $L_2$ as well as the pivot movement $L_1$ of the doctor beam 12, as in the arrangement of the embodiment shown in FIGS. 1A and 1B. There may also be only one bearing 13$a_1$, 13$_{a2}$ . . . , in which connection the bearing extends over the length of the doctor beam 12.

As shown in the figure, the elongated guide 50 is associated with the frame R and comprises a curved, preferably spherical backup surface 50$a$, against which there is an abutment bearing surface 50$b$ associated with the doctor beam 12. A pressurized hydraulic medium, such as oil or water, is passed through a duct 50$c$ between the backup surface 50$a$ and the abutment surface 50$b$. Thus, for example, water or hydraulic oil may serve as a pressure medium.

What is claimed is:

1. A doctor apparatus comprising:

a lightweight doctor beam;

bearing means arranged in abutment with said doctor beam, said bearing means being structured and arranged to permit said beam to move in a pivot direction ($L_1$) and a linear oscillatory direction ($L_2$);

loading members structured and arranged to load a first end of the doctor beam and thereby move said doctor beam in said pivot direction and linear oscillatory direction;

wherein said loading members and said doctor beam are structured and arranged such that a relative linear movement takes place between said loading members and a surface of said doctor beam when said beam is moved in said linear oscillatory direction.

2. The doctor apparatus according to claim 1, wherein said loading members are loading hoses.

3. The doctor apparatus according to claim 1, wherein said doctor beam is made of a composite material including carbon fibers.

4. The doctor apparatus according to claim 2, further comprising:

a frame, wherein said loading hoses are coupled to said frame, said doctor beam arranged between said loading hoses; and wherein a surface of said doctor beam is structured and arranged to function as a backup surface for the loading hoses when the doctor beam is moving in said pivot direction.

5. The doctor apparatus according to claim 2, further comprising:

wherein said loading hoses are connected to said doctor beam;

an elongated part connected to the frame and arranged between the loading hoses, wherein said elongated part functions as a backup part when the loading hoses are loaded.

6. The doctor apparatus according to claim 1, wherein said doctor beam defines a blade holder at one end of said doctor beam, said blade holder defining a recess structured and arranged to receive a blade; and said apparatus further comprises:

a backup plate coupled to said doctor beam for holding said blade in said recess.

7. The doctor apparatus according to claim 1, wherein said bearing means are sliding bearings.

8. The doctor apparatus according to claim 1, wherein said bearing means are roller bearings.

9. The doctor apparatus according to claim 1, wherein said bearing means are ball bearings.

10. The doctor apparatus according to claim 1, wherein said bearing means comprise:

a frame;

a guide coupled to said frame, said guide having a curved backup surface;

an abutment bearing surface associated with said doctor beam; and wherein said curved backup surface and said abutment bearing surface are structured and arranged to permit a hydraulic fluid to pass between said curved backup surface and said abutment bearing surface to thereby form a hydrodynamic bearing.

11. A doctor apparatus comprising:

a lightweight doctor beam;

bearing means arranged in abutment with said doctor beam, said bearing means being structured and arranged to permit said beam to move in a pivot direction ($L_1$) and a linear oscillatory direction ($L_2$);

loading members structured and arranged to load a first end of the doctor beam and thereby move said doctor beam in said pivot direction; and an actuator for moving said doctor beam in a linear oscillatory direction;

wherein said loading members and said doctor beam are structured and arranged such that a relative linear movement takes place between said loading members and a surface of said doctor beam when said beam is moved in said linear oscillatory direction.

12. The doctor apparatus according to claim 11, wherein said actuator comprises:

a cylinder;

a spring arranged between said frame and the doctor beam, said spring structured and arranged to produce movement in a first linear oscillatory direction and said cylinder being structured and arranged to produce movement in a second linear oscillatory direction;

wherein said cylinder is controlled by means of limits so that a valve of said cylinder is regulated by means of an impulse derived from said limits.

13. The doctor apparatus according to claim 11, wherein said actuator is a pneumatic cylinder.

14. The doctor apparatus according to claim 11, wherein said actuator is a hydraulic cylinder.

15. The doctor apparatus according to claim 11, wherein said actuator is a eccentric mechanism which comprises:

a spring;

an electric motor having a shaft to which is connected an eccentric disk, said eccentric disk coupled to a backup surface of said doctor beam and arranged to oscillate the doctor beam against said spring.

16. The doctor apparatus according to claim 15, wherein said spring is a pressure spring.

17. The doctor apparatus according to claim 11, wherein said actuator is a magnetic actuator.

* * * * *

UNITED STATES PATENT AND TRADEMARK OFFICE

CERTIFICATE OF CORRECTION

PATENT NO. : 6,547,932 B1
DATED : April 15, 2003
INVENTOR(S) : Leinonen, Antti et al.

It is certified that error appears in the above-identified patent and that said Letters Patent is hereby corrected as shown below:

Title page,
Item [75], the residence of the sixth Inventor should be set forth as -- Jyska, Finland --.

Signed and Sealed this

Nineteenth Day of August, 2003

JAMES E. ROGAN
*Director of the United States Patent and Trademark Office*